US010080706B2

(12) United States Patent
Fernandez et al.

(10) Patent No.: US 10,080,706 B2
(45) Date of Patent: Sep. 25, 2018

(54) SPRING LOADED NIPPLE ASSEMBLY

(71) Applicants: Santiago Fernandez, Inglewood, CA (US); Tiffain Reneau, Inglewood, CA (US)

(72) Inventors: Santiago Fernandez, Inglewood, CA (US); Tiffain Reneau, Inglewood, CA (US)

( * ) Notice: Subject to any disclaimer, the term of this patent is extended or adjusted under 35 U.S.C. 154(b) by 0 days.

(21) Appl. No.: 15/346,237

(22) Filed: Nov. 8, 2016

(65) Prior Publication Data

US 2018/0125762 A1 May 10, 2018

(51) Int. Cl.
*A61J 9/00* (2006.01)
*A61J 11/04* (2006.01)

(52) U.S. Cl.
CPC ..... *A61J 11/045* (2013.01)

(58) Field of Classification Search
CPC ..... A45J 11/045
See application file for complete search history.

(56) References Cited

U.S. PATENT DOCUMENTS 1,545,436 A * 7/1925 McGeary ..... A61J 11/0015 215/11.1
1,562,853 A 11/1925 Schonberger
1,714,241 A * 5/1929 Reilly ..... A61J 11/045 215/11.1
3,457,958 A * 7/1969 Noren ..... F16L 45/00 138/89
3,593,870 A * 7/1971 Anderson ..... A61J 11/008 215/11.5
3,664,535 A * 5/1972 Mette ..... A61J 9/001 215/11.1
4,901,647 A 2/1990 Drabing
6,467,746 B1 10/2002 Paskiewicz
D527,160 S 8/2006 Yatsko et al.
7,473,061 B1 1/2009 Santangelo
7,784,760 B2 8/2010 Ramsey
8,205,557 B2 6/2012 Moore
2003/0215313 A1 11/2003 Hinkle

* cited by examiner

*Primary Examiner* — Tri Mai

(57) ABSTRACT

A spring loaded nipple assembly includes a cover including a top wall and a perimeter wall that is attached to and extends downwardly from the top wall. The perimeter wall has a cylindrical shape and the top wall has a central opening extending therethrough. A nipple is integrally coupled to the top wall and extends upwardly therefrom. The nipple extends around the opening and forms a seal around the opening. The nipple has a distal end with respect to the top wall and the distal end has an aperture extending therethrough. A threading engagement member is positioned on an inner surface of the perimeter wall. The threading engagement member engages threading on a neck of a fluid container.

1 Claim, 4 Drawing Sheets

SPRING LOADED NIPPLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to water bottle couplable nipple devices and more particularly pertains to a new water bottle couplable nipple device for allowing a single nipple to accommodate variously sized threaded necks of fluid containers.

BRIEF SUMMARY OF THE INVENTION

An embodiment of the disclosure meets the needs presented above by generally comprising a cover including a top wall and a perimeter wall that is attached to and extends downwardly from the top wall. The perimeter wall has a cylindrical shape and the top wall has a central opening extending therethrough. A nipple is integrally coupled to the top wall and extends upwardly therefrom. The nipple extends around the opening and forms a seal around the opening. The nipple has a distal end with respect to the top wall and the distal end has an aperture extending therethrough. A threading engagement member is positioned on an inner surface of the perimeter wall. The threading engagement member is configured to engage threading on a neck of a fluid container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
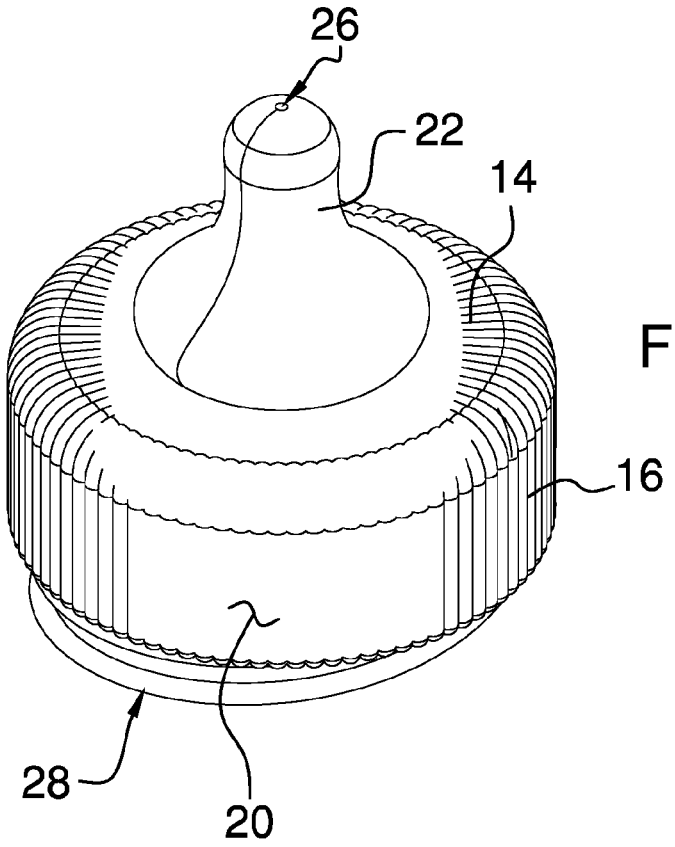
FIG. 1 is a top perspective view of a spring loaded nipple assembly according to an embodiment of the disclosure.
Figure 2:
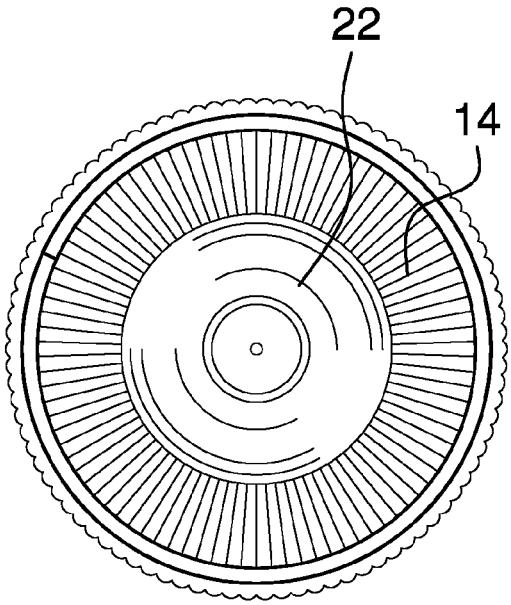
FIG. 2 is a bottom view of an embodiment of the disclosure.
Figure 3:
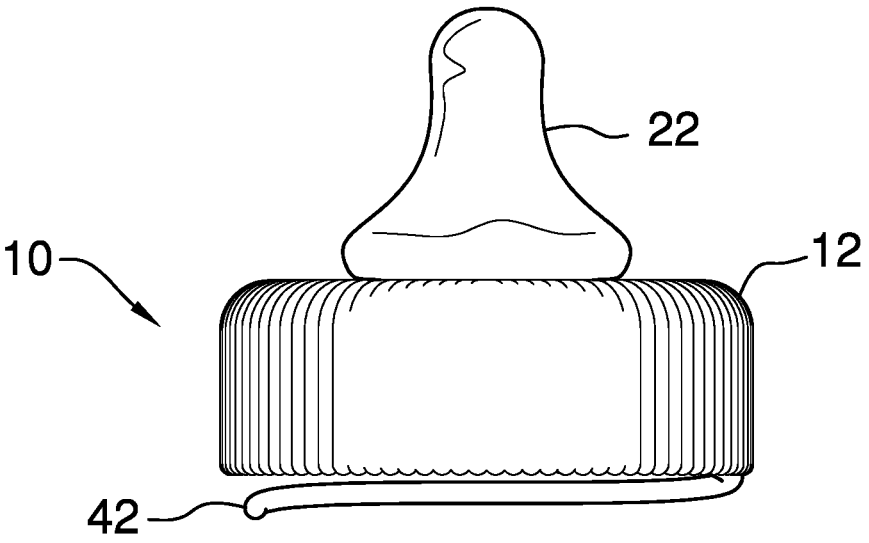
FIG. 3 is a side view of an embodiment of the disclosure.
Figure 4:
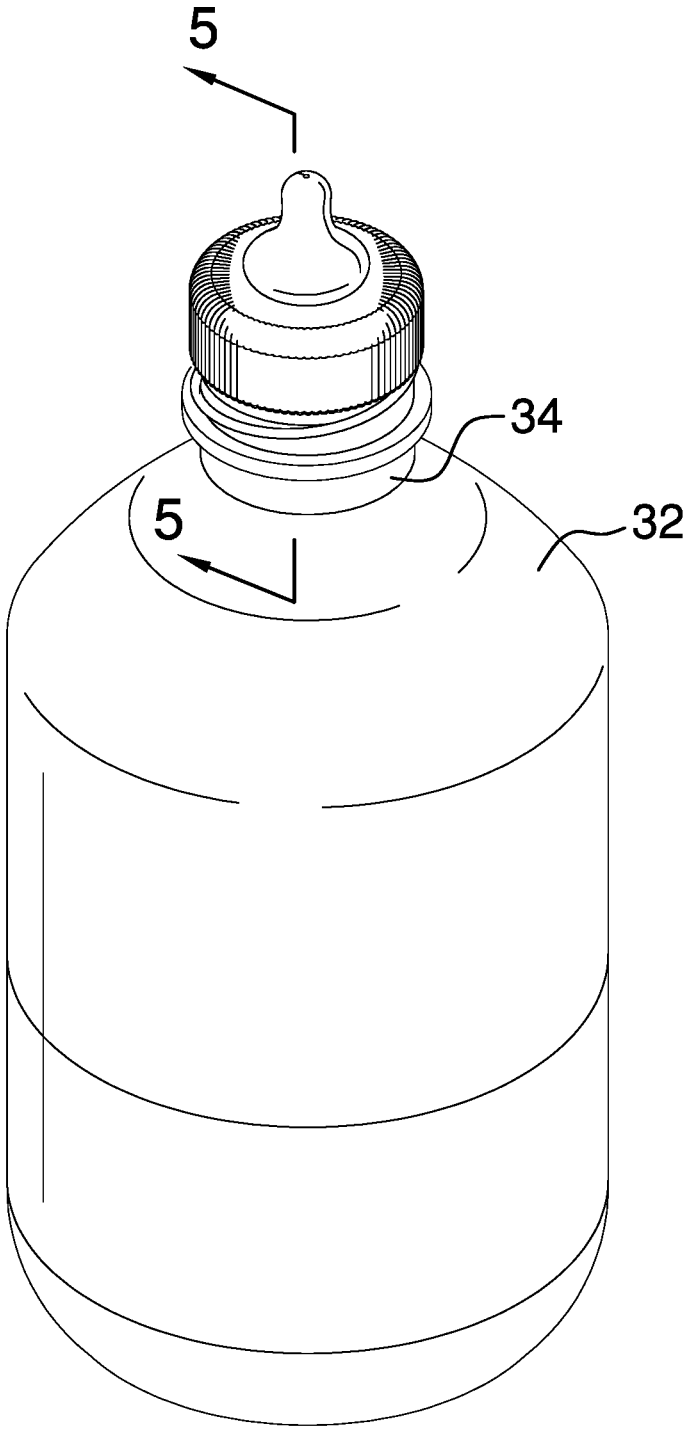
FIG. 4 is a perspective in-use view of an embodiment of the disclosure.
Figure 5:
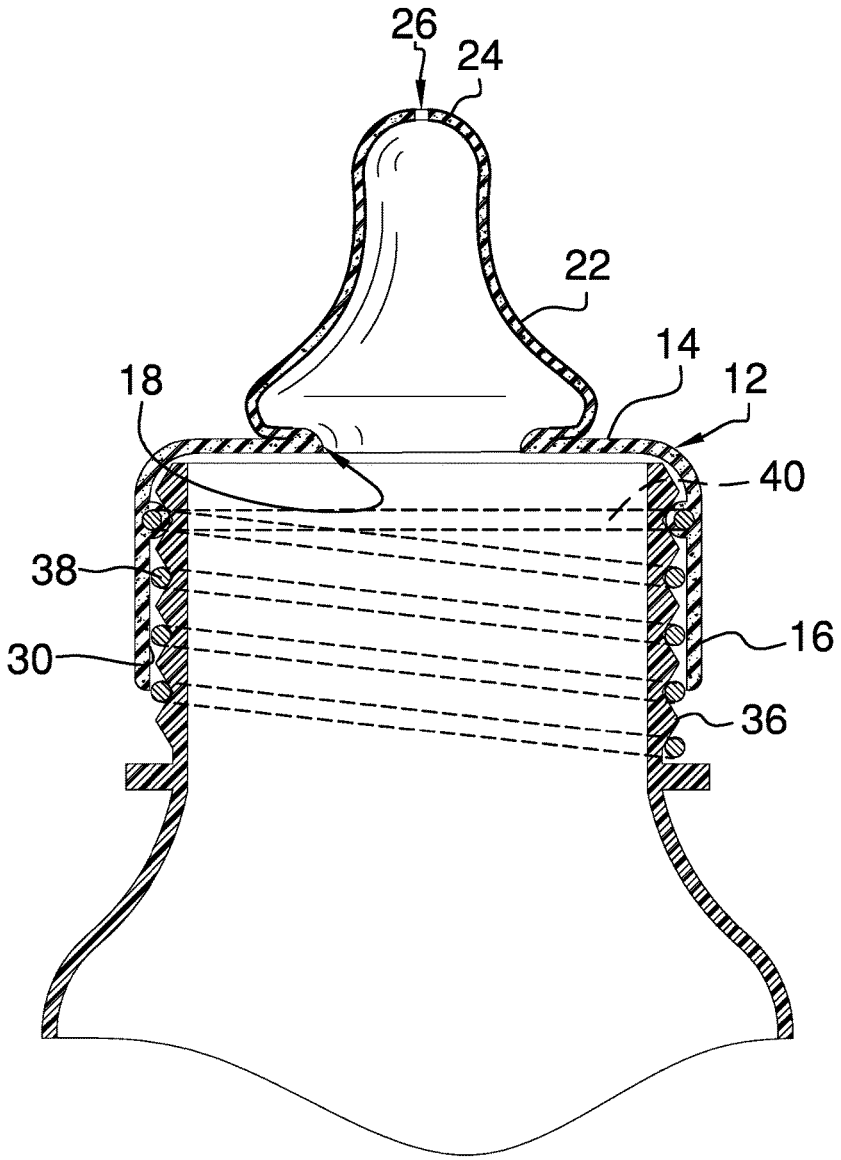
FIG. 5 is a cross-sectional view of an embodiment of the disclosure taken along line 5-5 of FIG. 4.

With reference now to the drawings, and in particular to FIGS. 1 through 5 thereof, a new water bottle couplable nipple device embodying the principles and concepts of an embodiment of the disclosure and generally designated by the reference numeral 10 will be described.

As best illustrated in FIGS. 1 through 5, the spring loaded nipple assembly 10 generally comprises a cover 12 including a top wall 14 and a perimeter wall 16 that is attached to and extends downwardly from the top wall 14. The cover 12 is comprised of a resiliently stretchable material such as an elastomeric material. The perimeter wall 16 has a cylindrical shape and the top wall has a central opening 18 extending therethrough. An outer surface 20 of the perimeter wall 16 may include gripping undulations to facilitate gripping of the perimeter wall 16. A nipple 22 is integrally coupled to the top wall 14 and extends upwardly therefrom. The nipple 22 extends around the opening 18 and forms a seal around the opening 18. The nipple 22 and cover 12 may comprise a unitary structure. The nipple 22 has a distal end 24 with respect to the top wall 14 and the distal end 24 has an aperture 26 extending therethrough.

A threading engagement member 28 is positioned on an inner surface 30 of the perimeter wall 16. The threading engagement member 28 is configured to engage threading 36 on a neck 34 of a fluid container 32. The perimeter wall 16 urges the threading engagement member 28 into engagement with the threading 36 to retain the perimeter wall 16 engaged with the neck 34. The threading engagement member 28 may comprise a coiled wire 38 that is configured to engage and threadably couple itself with the threading 36 as the coiled wire 38 is rotated when in contact with the threading 36 to releasably retain the cover 12 on the neck 34. The coiled wire 38 acts as a coil spring with a diameter than can change relative to the neck 34. For this reason, the coiled wire 38 cannot generally be completely attached to the perimeter wall 16 but would typically be attached to the cover 12 at one more discrete points. For example, an upper ring 40 of the coiled wire 38 may be embedded into or otherwise attached to the perimeter wall 16 to ensure that the coiled wire 38 rotates with the perimeter wall 16. The coiled wire 38 may include a free end 42 extending downwardly from the cover 12 to facilitate engagement with the threading 36.

In use, the cover 12 is placed on a conventional drinking or fluid container 32 having a threaded neck 34 to turn the drinking container 32 into a bottle. The perimeter wall 16 and the threading engagement member 28 allow the cover 12 to engage different sized necks 34 as needed by a user of the assembly 10.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A nipple assembly comprising:

a cover including a top wall and a perimeter wall being attached to and extending downwardly from said top wall, said cover being comprised of a resiliently stretchable material, said perimeter wall having a cylindrical shape, said top wall having a central opening extending therethrough;

a nipple being integrally coupled to said top wall and extending upwardly therefrom, said nipple extending around said opening and forming a seal around said opening, said nipple having a distal end with respect to said top wall, said distal end having an aperture extending therethrough;

a threading engagement member being positioned on an inner surface of said perimeter wall, said threading engagement member comprising coiled wire, said coiled wire having an exposed portion extending from said perimeter wall of said cover wherein said coiled wire is configured for engaging threading on a neck of a bottle facilitating expansion of said resiliently stretchable material of said cover over the neck of the bottle as said coiled wire is rotated onto the neck of the bottle said cover is configured to said coiled wire into engagement with the threading as said coiled wire is further rotated while in contact with the threading and said perimeter wall extends over the neck of the bottle.

* * * * *